US007985855B2

(12) United States Patent
Maruyama et al.

(10) Patent No.: US 7,985,855 B2
(45) Date of Patent: Jul. 26, 2011

(54) METHOD FOR MODIFYING FIBERS

(75) Inventors: Naosuke Maruyama, Joetsu (JP); Kazuhisa Hayakawa, Joetsu (JP); Soji Tanioka, Tokyo (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 191 days.

(21) Appl. No.: 11/168,372

(22) Filed: Jun. 29, 2005

(65) Prior Publication Data

US 2006/0000026 A1 Jan. 5, 2006

(30) Foreign Application Priority Data

Jun. 30, 2004 (JP) ..... 2004-192517
Feb. 22, 2005 (JP) ..... 2005-045206
Jun. 9, 2005 (JP) ..... 2005-169335

(51) Int. Cl.
*D06M 15/09* (2006.01)
*C08B 11/02* (2006.01)
*C08B 11/08* (2006.01)

(52) U.S. Cl. ..... 536/124; 162/143; 536/95; 536/99

(58) Field of Classification Search ..... 536/59, 536/85, 124; 162/143
See application file for complete search history.

(56) References Cited

U.S. PATENT DOCUMENTS 2,017,852 A 10/1935 Chisholm
2,087,237 A 7/1937 Bolton
2,253,297 A 8/1941 Houghton
2,388,764 A * 11/1945 Reichel et al. ..... 536/90
5,150,502 A * 9/1992 Roberson ..... 19/105
2004/0133990 A1 * 7/2004 Tanioka et al. ..... 8/115.51

FOREIGN PATENT DOCUMENTS

EP 1120427 A1 * 8/2001
EP 1437439 A2 7/2004
GB 600355 4/1948
JP 2004-218102 A 8/2004
JP 61252369 A * 8/2004

OTHER PUBLICATIONS

Hawley's Condensed Chemical Dictionary, 14th Edition, 2002—1page web printout.*
Definition of dissolve, Oxford English Dictionary, http://dictionary.oed.com, accessed online on May 24, 2010.*
Definition of dispersion, Oxford English Dictionary, http://dictionary.oed.com, accessed online on May 24, 2010.*
Definition of colloid, Oxford English Dictionary, 1989, 2nd edition, http://www.oed.com, accessed online on Dec. 13, 2010.*
English language abstract of JP 2003252724 (Sep. 10, 2003).
English language abstract of JP 60137938 (Jul. 22, 1985).

* cited by examiner

*Primary Examiner* — Shaojia Anna Jiang
*Assistant Examiner* — Jonathan Lau
(74) *Attorney, Agent, or Firm* — Birch, Stewart, Kolasch & Birch, LLP

(57) ABSTRACT

A method for modifying fibers is provided, which method comprises dispersing in water or a dilute alkali aqueous solution under shear a cellulose ether having such a low degree of substitution that a molar degree of substitution with an alkyl group and/or a hydoxyalkyl group ranges from 0.05 to 1.3, applying the resulting dispersion to fibers, and drying the applied fibers.

7 Claims, No Drawings

METHOD FOR MODIFYING FIBERS

CROSS-REFERENCE TO RELATED APPLICATION

This non-provisional application claims priority under 35 U.S.C. §119(a) on Patent Application Nos. 2004-192517, 2005-045206 and 2005-169335 filed in Japan on Jun. 30, 2004, Feb. 22, 2005 and Jun. 9, 2005, respectively, the entire contents of which are hereby incorporated by reference.

BACKGROUND OF THE INVENTION

This invention relates to a method for modifying fibers.

For the purposes of preventing fibers from fluffing, improving tensile strength and wear resistance of fibers, imparting static resistance and water absorption to fibers, and providing good fibrous texture or hand such as smooth and dry feeling to fibers, there has been proposed a method called "imitation linen finishing" wherein viscose is applied to fibers and is coagulated and regenerated, followed by rinsing with water and drying to cover the fiber surfaces with regenerated cellulose.

In this connection, however, the method of modifying fibers by coverage with viscose-derived, regenerated cellulose includes the steps of applying to fibers a solution, i.e., viscose, obtained by dissolving in a sodium hydroxide aqueous solution cellulose xanthate which is prepared by degenerating cellulose with highly toxic carbon disulfide, and subsequently coagulating and regenerating the cellulose. This presents a problem that in the steps of preparing cellulose xanthate and coagulating and regenerating the cellulose, workers undergo exposure to carbon disulfide. In addition, the regenerated cellulose per se used for the coverage according to this fiber modifying method is unsatisfactory with respect to water absorption, thus causing the problem in that improvements in static resistance, water absorption and shrink proofing are not satisfactory.

Further, with the "imitation linen finishing", an alkali aqueous solution is used, which needs the step of neutralization with an acid for coagulation, thus involving a difficulty in modifying fibers that are poor in resistance to alkali.

To solve the problem on the modification of fibers by coverage with viscose-derived, regenerated cellulose, a method of covering fiber surfaces with regenerated cellulose has been proposed. In the method, cellulose per se is dissolved in a sodium hydroxide aqueous solution and attached to fibers, followed by coagulation and regeneration (JP-A 61-252369).

However, this method needs not only the dissolution of cellulose in a sodium hydroxide aqueous solution at low temperature, but also the use of cellulose of the type which has a reduced degree of crystal structure sufficient to increase solubility, e.g. cellulose that is obtained by acid hydrolyzing wood pulp and grinding it in a ball mill, or regenerated cellulose that is prepared from viscose, thus imposing limitation on the method.

SUMMARY OF THE INVENTION

Accordingly, it is an object of the invention to provide a method for modifying fibers which is free of a problem on toxicity based on carbon disulfide, allows an easy manufacturing process and enables fibers having a poor resistance to alkali to be modified.

It is another object of the invention to provide a method for modifying fibers so that the resulting fibers can be prevented from fluffing and has excellent tensile strength, wear resistance, static resistance and water absorption.

There has already been-proposed a method wherein a cellulose ether having a low degree of substitution is dissolved in a solution of an alkali such as sodium hydroxide typically having a concentration of about 10% by weight and applied onto fibers, after which the solution is coagulated and regenerated (JP-A 2004-218102). Further intensive studies have been made and, as a result, a method of modifying fibers has been found wherein simple steps using one liquid component without use of an alkali aqueous solution having a high alkali concentration are carried out unlike the case as in conventional "imitation linen finishing" where an alkali aqueous solution is applied onto fibers, neutralized with an acid for coagulation, followed by washing and drying.

More particularly, a cellulose ether having a molar degree of substitution with an alkyl group and/or a hydroxyalkyl group as low as 0.05 to 1.3 is suspended or dispersed in water or a dilute alkali aqueous solution having a concentration of an alkali of 1% by weight or less under shear force to obtain a dispersion, and the dispersion is applied onto fibers and dried. Thus, an alkali aqueous solution having a high alkali concentration is not used and the step of neutralization and coagulation with an acid is not needed, so that it has become possible to modify fibers that are low in alkali resistance, as will be difficult in handling with "imitation linen finishing" ordinarily using an aqueous solution of an alkali such as sodium hydroxide having a high concentration. Moreover, it has been found that fiber modification finishing is enabled without a problem on carbon disulfide to provide modified fibers that can be prevented from fluffing and have high tensile strength and excellent wear resistance, static resistance and water absorption. The invention has been accomplished based on these findings.

According to the invention, there is provided a method for modifying fibers comprising steps of suspending and dispersing a cellulose ether having such a low degree of substitution that a molar degree of substitution with an alkyl group and/or a hydroxyalkyl group ranges from 0.05 to 1.3 in water or a dilute alkali aqueous solution having a concentration of an alkali of 1% by weight or less under shear force, applying the resulting dispersion to fibers, and drying the dispersion-applied fibers.

In this case, the low-substituted cellulose ether should preferably be a low-substituted hydroxypropyl cellulose having a molar degree of substitution of 0.1 to 0.7.

In the method for modifying fibers wherein the dispersion of the low-substituted cellulose ether in water or the dilute alkali aqueous solution by application of a shear force thereto may be prepared by a method wherein dispersed particles in a low-substituted cellulose ether dispersion to be sheared are caused to mutually collide or to collide against a collision plate for grinding, using a vibration ball mill, colloid mill, homomixer or homogenizer. In this case, it is preferred that the low-substituted cellulose ether is dissolved in an aqueous solution of an alkali, and the solution is neutralized with an equivalent of an acid or such an amount of an acid that a solution having a concentration of an alkali of 1% by weight or less is obtained, thereby settling the low-substituted cellulose ether to prepare the low-substituted cellulose ether dispersion to be sheared. The dispersion of the low-substituted cellulose ether in water or the dilute alkali aqueous solution by application of a shear force thereto may also be prepared by a method wherein the low-substituted cellulose ether is dissolved in an alkali aqueous solution having a concentration of an alkali of 2% by weight or more and the alkali solution is milled under shear by means of a colloid mill or ground through collision by use of a homogenizer, while the solution is neutralized with an equivalent of an acid or such an amount of an acid that a solution having a concentration of an alkali of 1% by weight or less is obtained.

Preferably, a low-substituted cellulose ether dispersion to be sheared is injected from a nozzle with a pressure of 70 to 250 MPa so that the low-substituted cellulose ether dispersion to be sheared is caused to mutually collide or collide against a collision plate with an angle of collision of 90 to 180° and the number of collision of 1 to 200 sufficient to cause the particles of the low-substituted cellulose ether to be so fine that an average length thereof is reduced at ¼ or below, thereby obtaining the sheared low-substituted cellulose ether dispersion. Alternatively, particles of the low-substituted cellulose ether may be ground by milling a low-substituted cellulose ether dispersion to be sheared with a shear force of at least 500 $sec^{-1}$ one time to 60 times, thereby obtaining the sheared low-substituted cellulose ether dispertion. The concentration of the low-substituted cellulose ether in the sheared dispersion preferably ranges from 0.5 to 20% by weight, and the sheared low-substituted cellulose ether dispersion is applied to fibers in such an amount that a pickup ranges 10 to 500% by weight.

According to the method of the invention, fibers can be modified without use of a noxious solvent such as carbon disulfide so that good safety is ensured and a fabrication process is not complicated. The resulting modified fibers are unlikely to suffer fluffing, are improved in tensile strength and are excellent in wear resistance, static resistance and water absorption. When compared with conventional "imitation linen finishing", modification is possible using a simpler procedure, with the attendant advantage in that fibers having a low resistance to alkali can be modified.

DETAILED DESCRIPTION OF THE PREFERRED EMBODIMENTS

The fibers used in the invention are not critical in type. Examples of the fibers include synthetic fibers such as polyethylene fibers, polypropylene fibers, polyester fibers, nylon fibers, acrylic fibers, vinylon fibers, rayon fibers, polyvinyl chloride fibers, and polyvinylidene chloride fibers; natural fibers such as of cotton, cellulose, and hemp; and animal fibers such as wool, silk, and cashmere. In the present invention, animal fibers that are less resistant to an alkali, e.g. wool, silk, and cashmere, and blends of polyesters and wool may also be used appropriately. The term "fibers" used herein includes thread or yarn-shaped fibers, i.e., threads, woven fabrics or textiles of thread-shaped fibers, or non-woven fabrics or textiles of thread-shaped fibers.

The cellulose ether having a low degree of substitution used in the invention means a cellulose ether wherein the hydrogen atoms of the hydroxyl groups of glucose rings of cellulose are substituted with an alkyl group and/or a hydroxyalkyl group provided that a molar degree of substitution ranges from 0.05 to 1.3, preferably from 0.1 to 0.7. The cellulose ether should not be dissolved in water but is able to provide a dispersion of high stability when undergoing high shear force. If the molar degree of substitution is lower than 0.05, such a cellulose ether may not provide a stable dispersion even when applied with shear force. On the contrary, when the molar degree exceeds 1.3, dissolution in water increases with the possibility that waterproofing lowers.

In the present specification, the cellulose ether of a low degree of substitution is referred as a low-substituted cellulose ether hereinafter.

Examples of the cellulose ether of a low degree of substitution include low-substituted alkyl celluloses such as low-substituted methyl cellulose, and low-substituted ethyl cellulose; low-substituted hydroxyalkyl celluloses such as low-substituted hydroxyethyl cellulose, and low-substituted hydroxypropyl cellulose; low-substituted hydroxyalkylalkyl celluloses such as low-substituted hydroxypropylmethyl cellulose, low-substituted hydroxyethylmethyl cellulose, and low-substituted hydroxyethylethyl cellulose. Of these, low-substituted hydroxypropyl cellulose is preferred.

The modification of fibers according to the invention is carried out by a procedure which includes suspending or dispersing such a low-substituted cellulose ether as set out hereinabove in water or a dilute alkali aqueous solution having a concentration of an alkali of 1% by weight or less under shear force, applying the sheared dispersion to fibers by coating or dipping, if necessary, removing the excessive dispersion applied to the fibers by means of a centrifugal dehydrator, a mangle, a knife coater or the like, and drying the applied fibers.

In the present specification, the low-substituted cellulose ether dispersion before shearing is referred as a dispersion to be shear, and the low-substituted cellulose ether dispersion after shearing is referred as a sheared dispersion hereinafter.

The low-substituted cellulose ether dispersion to be sheared can be obtained by adding to and dispersing in water or a dilute alkali aqueous solution having a concentration of an alkali such as sodium hydroxide or potassium hydroxide of 1% by weight or less, especially 0.5% by weight or less. The dispersion to be sheared can also be obtained by dissolving the low-substituted cellulose ether in an alkali solution having a concentration of an alkali such as sodium hydroxide or potassium hydroxide of 2 to 25% by weight, especially 3 to 15% by weight, and neutralizing the alkali solution with an equivalent of an acid or such an amount of an acid that a dilute alkali aqueous solution having a concentration of an acid of 1% by weight or less can be obtained, thereby settling the low-substituted cellulose ether in the solution.

For the dispersion of a low-substituted cellulose ether in water or the dilute alkali aqueous solution by application of a shear force thereto, a method wherein dispersed particles in the low-substituted cellulose ether dispersion to be sheared are caused to be mutually collide for grinding the particles, or a method wherein the particles are caused to collide against a collision plate for milling and grinding the particles can be employed, although the method is not limited thereto. Devices of preparing the sheared low-substituted cellulose ether dispersion through mutual collision of the particles of the low-substituted cellulose ether dispersion to be sheared or by collision against a collision plate are not critical in type and include, for example, vibration ball mills, colloid mills, homomixers, homogenizers and the like. They are commercially available. For example, as a colloid mill, MASSCOLLOIDER or CERENDIPITOR made by Masuko Sangyo Co., Ltd. may be used. From the standpoint of preparing a uniform sheared dispersion, preferred homogenizers are those wherein a dispersion to be sheared is jetted from a valve orifice under high pressure to subject the low-substituted cellulose ester to frictional collision and which include "HOMOGENIZER" made by Sanwa Machine Co., Inc., "ULTIMIZER SYSTEM" made by Sugino Machine Ltd., "MICROFLUIDIZER" made by Mizuho Industrial Co., Ltd., "HIGH PRESSURE HOMOGZENIZER" made by Gaulin, and the like, ultrasonic homogenizers using supersonic vibrations such as "ULTRASONIC HOMOGEMIZER" made by Nippon Seiki Co., Ltd., and the like. The sheared dispersions repeatedly treated by these devices may also be used.

Further, for preparing the sheared dispersion, as described in JP-A 2002-204951, a low-substituted cellulose ether may be dissolved in an aqueous solution of an alkali such as sodium hydroxide or potassium hydroxide having a concentration of an alkali of 2 to 25% by weight, especially 3 to 15% by weight and the alkali solution is milled under shear by means of a colloid mill or ground through collision by use of such a homogenizer as mentioned above, while the solution is neutralized with an equivalent of an acid (such as hydrochloric acid, sulfuric acid or the like) or such an amount of an acid that a solution having a concentration of an alkali of 1% by weight or less is obtained, thereby obtaining a sheared dispersion.

The collision of low-substituted cellulose ether can be conducted as follows.

The low-substituted cellulose ether dispersions to be sheared are injected from each nozzle at a pressure of 10 to 250 MPa so that the dispersions to be sheared mutually collide with an angle of collision of 90 to 180°, preferably 95 to 178°, more preferably 100 to 170°. Alternatively, the low-substituted cellulose ether dispersion to be sheared is injected from a nozzle at a pressure of 70 to 250 MPa so that the dispersion to be sheared collides against a collision plate with an angle of collision of 90 to 180°, preferably 95 to 178°, more preferably 100 to 120°. The number of collisions should preferably be 1 to 200, especially 5 to 120. The collisions should preferably be conducted so that it is sufficient to cause the particles of the low-substituted cellulose ether to be so fine that an average length thereof is reduced at ¼ or below, preferably ⅕ to 1/100, more preferably ⅙ to 1/50, most preferably ⅐ to 1/20. The average length can be obtained as an average value of the length-measuring results for at least 50 particles of the low-substituted cellulose ether in a microphotograph of a polarization microscope or a transmission electromicroscope. Outside the ranges of the pressure, the angle of collision and the number of collisions, satisfactory, uniform dispersion may not be ensured and the molecular weight of low-substituted cellulose may lower extremely, with the possibility that a satisfactory effect of improving the hand or texture of the cellulose cannot be obtained.

Where the low-substituted cellulose ether is dispersed by milling, it is preferred to mill the low-substituted cellulose ether so that a dispersion to be sheared is applied with a shear force of at least 500 $sec^{-1}$, preferably at least 1,000 $sec^{-1}$, more preferably at least 1,500 $sec^{-1}$. The shear force may be applied repeatedly or continuously, and the number of the application of the shear force is preferably 1 to 60, more preferably 10 to 60. Less than one time, the degree of dispersion would be insufficient, resulting in lowering the film-forming property of the low-substituted cellulose ether. More than 60 times would cause the reduction of polymerization degree of the low-substituted cellulose ether, resulting in lowering the film strength.

On the other hand, the concentration of the low-substituted cellulose ether in the sheared dispersion ranges from 0.5 to 20% by weight, preferably from 1 to 10% by weight. If the concentration is smaller than 0.5% by weight, no or little effect of improving the hand of fibers is expected. When the concentration exceeds 20% by weight, the sheared dispersion becomes so high in viscosity that it is unlikely to realize a given amount of the cellulose ether being applied to fibers.

The coating or application of low-substituted cellulose ether dispersion may be carried out using coaters such as a one-thread sizing machine, a blade coater, a transfer coater, and an air doctor coater, or using dipping machines such as of a pre-wet type, a float type, and a doctor bar type to dip fibers in the sheared dispersion. After completion of coating operations, the fibers are dried at approximately 100° C. to obtain a fiber product improved in hand or texture suited for the purpose of the invention.

The amount of the sheared low-substituted cellulose ether dispersion attached to fibers is appropriately determined, and a pickup, i.e., (weight of an applied sheared low-substituted cellulose ether dispersion/weight of fiber substrate)×100, ranges 10 to 500% by weight, preferably 20 to 300% by weight. When the pickup is smaller than 10% by weight, a coverage of fibers with the low-substituted cellulose ether becomes small, with the possibility that the fibers are not improved satisfactorily. On the contrary, when the pickup exceeds 500% by weight, the hand of the resulting fibers become worsened and the improvements in air permeability and hands such as a smooth feeling may not be attained to such an extent as to match too large an amount used.

The clothes and fabrics made of threads obtained from the modified fibers of the invention are improved in air permeability and have a smooth feeling and flexibility. If titanium oxide is added to a sheared low-substituted cellulose ether dispersion in an amount of about 1 to 20% by weight, fibers or clothes having photocatalytic function can be obtained. Alternatively, dyes or pigments may be added to a sheared low-substituted cellulose ether dispersion for coloration. Besides, all types of inorganic materials, organic material, and natural materials may be added to a sheared low-substituted cellulose ether dispersion within ranges of amounts not impeding the purposes of the invention, fibers modified as desired may be obtained.

EXAMPLES

Examples are shown to illustrate the invention, which should not be construed as limiting the invention thereto. A comparative example is also shown. It will be noted that in the following examples and comparative example, a degree of substitution of cellulose ether means a molar degree of substitution unless otherwise indicated.

Example 1

100 g of a low-substituted cellulose ether whose degree of substitution with hydroxypropyl group was at 0.25 was dispersed in 900 g of water, followed by treating the dispersion to be sheared by means of a micronizer "CERENDIPITOR" made by Masuko Sangyo Co., Ltd. under conditions of a milling clearance of 60 microns, a number of revolutions of 1500 $min^{-1}$ and 10 milling cycles, thereby obtaining a sheared dispersion. Next, Knit Comber cotton thread #30/1 was dipped in this sample solution and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Example 2

50 g of a low-substituted cellulose ether whose degree of substitution with hydroxypropyl group was at 0.25 was dispersed in 950 g of water, followed by subjecting the dispersion to be sheared to high pressure dispersion at a pressure of 150 MPa by means of an opposed, collision unit of "ALTEMIZER" made by Sugino Machine Ltd. This procedure was repeated ten times to provide a sheared low-substituted cellulose ether aqueous dispersion. Next, Knit Comber cotton thread #30/1 was dipped in this sample dispersion and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Example 3

50 g of a low-substituted cellulose ether whose degree of substitution with hydroxypropyl group was at 0.25 was dispersed in 475 g of water, after which 475 g of a 20 wt % sodium hydroxide aqueous solution was added thereto to prepare a sodium hydroxide aqueous solution of the low-substituted cellulose ether. While agitating with a homomixer at 5,000 minute$^{-1}$, 142.5 g of glacial acetic acid was gradually added to the solution and neutralized to prepare a creamy low-substituted cellulose ether aqueous dispersion. This dispersion to be sheared was subjected to high pressure dispersion at a pressure of 150 MPa by means of an opposed, collision unit of "ALTEMIZER" made by Sugino Machine Ltd. This milling procedure was repeated ten times to prepare a sheared low-substituted cellulose ether aqueous dispersion. Next, Knit Comber cotton thread #30/1 was dipped in this sample dispersion and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Example 4

50 g of a low-substituted cellulose ether whose degree of substitution with hydroxypropyl group was at 0.15 was dispersed in 950 g of 0.5 wt % sodium hydroxide aqueous solution, followed by subjecting the dispersion to be sheared to high pressure dispersion at a pressure of 150 MPa by means of an opposed, collision unit of "ALTEMIZER" made by Sugino Machine Ltd. This procedure was repeated ten times to prepare a sheared low-substituted cellulose ether aqueous dispersion. Next, knit comber cotton thread #30/1 was dipped in this sample dispersion and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Example 5

50 g of a low-substituted cellulose ether whose degrees of substitution with methyl group and hydroxypropyl group were at 0.14 and 0.14, respectively, was dispersed in 950 g of water, followed by subjecting the dispersion to be sheared to high pressure dispersion at 150 MPa by means of an opposed, collision unit of "ALTEMIZER" made by Sugino Machine Ltd. This procedure was repeated ten times to provide a sheared low-substituted cellulose ether aqueous dispersion. Next, knit comber cotton thread #30/1 was dipped in this sample dispersion and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Example 6

50 g of a low-substituted-cellulose ether whose degree of substitution with methyl group was at 0.21 was dispersed in 950 g of water, followed by subjecting the dispersion to be sheared to high pressure dispersion at 150 MPa by means of an opposed, collision unit of "ALTEMIZER" made by Sugino Machine Ltd. This procedure was repeated ten times to provide a sheared low-substituted cellulose ether aqueous dispersion. Next, knit comber cotton thread #30/1 was dipped in this sample dispersion and squeezed by means of a roller mangle to a pickup of 108%, followed by drying at 105° C. for 2 hours to obtain a sample.

The thus obtained sample was subjected to the following testing methods to assess a fluffing property, tensile strength, wear resistance, static resistance, and water absorption. The results are shown in Table 1.

Comparative Example 1

100 parts by weight of a viscose solution composed of 3% by weight calculated as cellulose of powdery cellulose KC Floc W100 made by Nippon Paper Industries Co., Ltd., 6% by weight of sodium hydroxide and 2.5% by weight of carbon disulfide was prepared and provided as a sample solution. Next, knit comber cotton thread #30/1 was dipped in this sample solution and squeezed by means of a roller mangle to a pickup of 108%, after which the squeezed thread was immersed in a solution made of 10% by weight of sodium sulfate and 10% by weight of sulfuric acid for coagulation. Thereafter, sufficient washing was carried out, followed by drying at 105° C. for 2 hours to obtain a sample.

The thus obtained sample was subjected to the following testing methods to assess fluffing resistance, tensile strength, wear resistance, static resistance, and water absorption. The results are shown in Table 1.

Fluffing Property

Using Optical Fluffing Tester, F-INDEX TESTER, made by Shikibo Ltd., a ratio of a reduced weight of fluffs having levels of 2 mm or below, 3 mm or below and 4 mm or below to an initial weight of a non-treated thread was determined.

Tensile Strength

Using a Tensilon tensile strength tester, made by A&D Co., Ltd. ten threads having a length of 100 mm was subjected to measurement of tensile strength to calculate a ratio to that of non-treated threads.

Wear Resistance

Hiruta's wear resistance tester was used to determine a number of cycles before a sample thread was broken, from which a value obtained by dividing the number by a number of cycles before breakage of a non-treated thread is calculated.

Static Resistance

A half life was measured according to the method of JIS L 1094-1980 to determine a static resistance as a ratio to that of a non-treated thread.

Water Absorption Rate

According to the method of JIS L 1096-1979, a length of water absorption in ten minutes was measured to determine a ratio to that of a non-treated thread.

TABLE 1

| | Name and Molar Degree of Substitution of Low-substituted Cellulose Ether | | | Evaluation | | | | |
|---|---|---|---|---|---|---|---|---|
| | Name | Methyl group | Hyroxy propyl group | Ratio in Fluffing Degree | Ratio in Tensile Strength | Ratio in Wear Resistance | Ratio in Static Resistance | Ratio in Water Absorption Rate |
| Example 1 | Low-substituted Hydroxypropyl Cellulose | — | 0.25 | 0.1 | 1.1 | 22 | 0.01 | 1.1 |
| Example 2 | Low-substituted Hydroxypropyl Cellulose | — | 0.25 | 0.03 | 1.2 | 31 | 0.01 | 1.1 |
| Example 3 | Low-substituted Hydroxypropyl Cellulose | — | 0.25 | 0.01 | 1.2 | 40 | 0.01 | 1.1 |
| Example 4 | Low-substituted Hydroxypropyl Cellulose | — | 0.15 | 0.01 | 1.3 | 50 | 0.01 | 1.2 |
| Example 5 | Low-substituted Hydroxypropylmethyl Cellulose | 0.14 | 0.14 | 0.07 | 1.1 | 21 | 0.01 | 1.2 |
| Example 6 | Low-substituted methyl Cellulose | 0.21 | — | 0.1 | 1.1 | 24 | 0.01 | 1.0 |
| Comparative Example 1 | Cellulose | — | — | 0.2 | 1.1 | 10 | 0.1 | 1.0 |

Japanese Patent Application Nos. 2004-192517, 2005-045206 and 2005-169335 are incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for modifying fibers consisting of the steps of:

dispersing a cellulose ether having such a low degree of substitution that a molar degree of substitution with an alkyl group and/or a hydroxyalkyl group ranges from 0.05 to 1.3 in water or a dilute alkali aqueous solution having a concentration of an alkali of 1% by weight or less under shear force so as to form a colloidal solution;

applying the resulting dispersion to animal fibers or a blend thereof; and drying the colloidal solution fibers.

2. The method of modifying fibers according to claim 1, wherein the animal fibers are wool, silk, cashmere or a blend thereof.

3. The method for modifying fibers according to claim 1, wherein the cellulose ether is a low-substituted hydroxypropyl cellulose having a molar degree of substitution of 0.1 to 0.7.

4. The method for modifying fibers according to claim 1, wherein the dispersion of the low-substituted cellulose ether in water or the dilute alkali aqueous solution by application of a shear force thereto is prepared by a method wherein dispersed particles in a low-substituted cellulose ether dispersion to be sheared are caused to mutually collide or to collide against a collision plate for grinding, using a vibration ball mill, colloid mill, homomixer or homogenizer.

5. The method for modifying fibers according to claim 1, wherein a low-substituted cellulose ether dispersion to be sheared is injected from a nozzle with a pressure of 70 to 250 MPa so that the low-substituted cellulose ether dispersion to be sheared is caused to mutually collide or collide against a collision plate with an angle of collision of 90 to 180° and the number of collision of 1 to 200 sufficient to cause the particles of the low-substituted cellulose ether to be so fine that an average length thereof is reduced at ¼ or below, thereby obtaining the sheared low-substituted cellulose ether colloidal solution.

6. The method for modifying fibers according to claim 1, wherein particles of the low-substituted cellulose ether are ground by milling a low-substituted cellulose ether dispersion to be sheared with a shear force of at least 500 $sec^{-1}$ one time to 60 times, thereby obtaining of the sheared low-substituted cellulose ether colloidal solution.

7. The method of modifying fibers according to claim 1, wherein the concentration of the low-substituted cellulose ether in the sheared dispersion ranges from 0.5 to 20% by weight, and the sheared low-substituted cellulose ether dispersion is applied to animal fibers or a blend thereof in such an amount that a pickup ranges 10 to 500% by weight.

* * * * *